US007730567B2

(12) United States Patent
Jaeger

(10) Patent No.: US 7,730,567 B2
(45) Date of Patent: Jun. 8, 2010

(54) MATTRESS LIFTING DEVICE

(76) Inventor: Arthur W. Jaeger, 1815 Oneida La., Mount Prospect, IL (US) 60056

( * ) Notice: Subject to any disclaimer, the term of this patent is extended or adjusted under 35 U.S.C. 154(b) by 32 days.

(21) Appl. No.: 12/075,257

(22) Filed: Mar. 10, 2008

(65) Prior Publication Data

US 2008/0222814 A1 Sep. 18, 2008

Related U.S. Application Data

(60) Provisional application No. 60/906,754, filed on Mar. 12, 2007.

(51) Int. Cl.
*A47C 31/00* (2006.01)

(52) U.S. Cl. ..... 5/658; 5/488

(58) Field of Classification Search ..... 5/488, 5/509.1, 658–660

See application file for complete search history.

(56) References Cited

U.S. PATENT DOCUMENTS

| | | | | |
|---|---|---|---|---|
| RE26,411 | E | 6/1968 | Alsobrook, Jr. | |
| 4,181,989 | A | 1/1980 | Bradley et al. | |
| 6,886,203 | B2 * | 5/2005 | Drakos et al. | 5/660 |
| 7,398,569 | B2 * | 7/2008 | Sakaldasis et al. | 5/488 |

* cited by examiner

*Primary Examiner*—Fredrick Conley
(74) *Attorney, Agent, or Firm*—James Ray & Assoc

(57) ABSTRACT

The invention provides a device for vertically lifting an end of a horizontally disposed mattress which includes an elongated member being disposed beneath the mattress and movable by way of a handle which is disposed on and secured to one end of the elongated member between a resting position wherein the elongated member is disposed coplanar with a bottom surface of the mattress and a lifting position wherein the elongated member is disposed generally perpendicular to the bottom mattress surface for lifting the end of the mattress in the vertical direction. The handle is releaseably secured to the end of the end of the elongated member for ease of securing the handle to an opposed end of the elongated member.

17 Claims, 4 Drawing Sheets

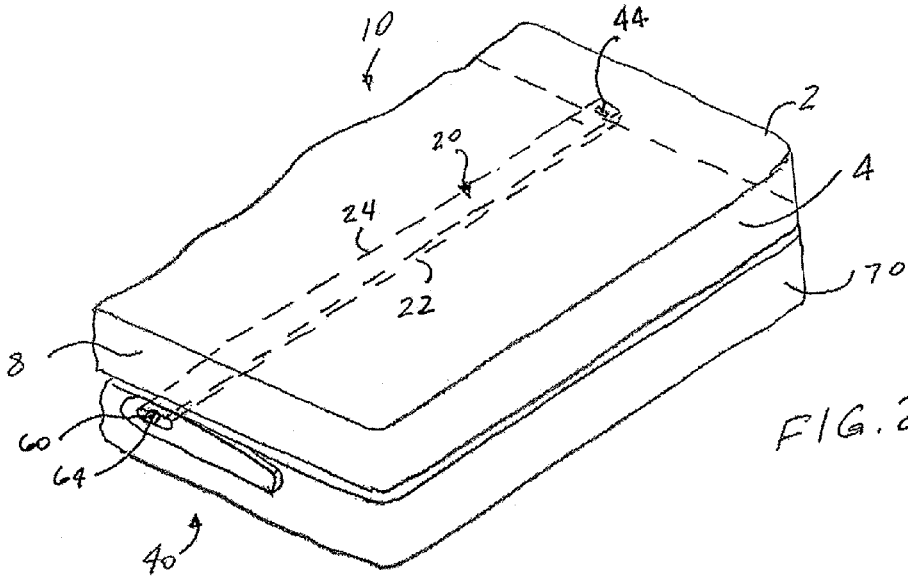
FIG. 2
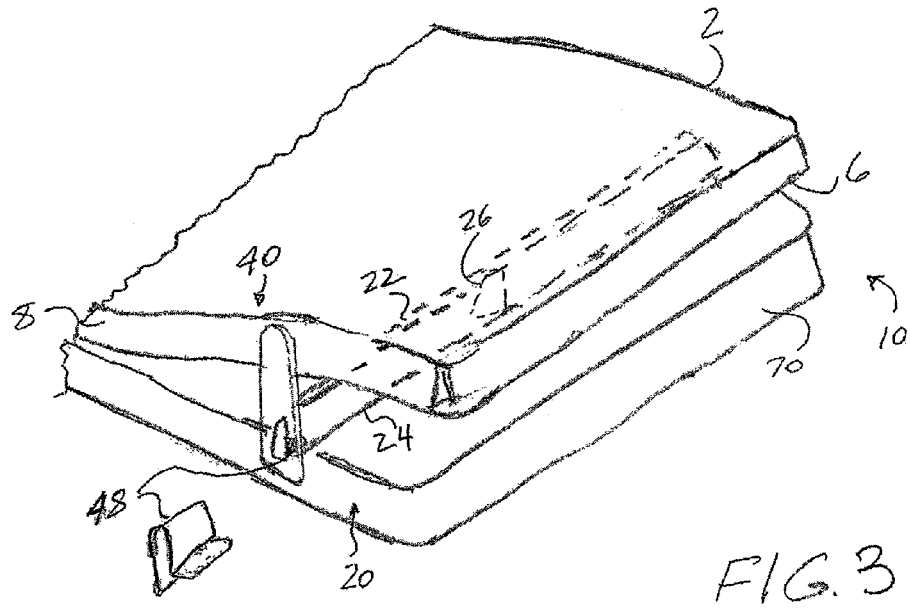
FIG. 3
FIG. 4

MATTRESS LIFTING DEVICE

CROSS-REFERENCE TO RELATED APPLICATIONS

This application is related to and claims priority from U.S. Provisional Patent Application Ser. No. 60/906,754 filed Mar. 12, 2007.

FIELD OF THE INVENTION

The present invention relates, in general, to mattress lifting devices and, more particularly, this invention relates to a manually operable device which is capable of lifting an end of the mattress.

BACKGROUND OF THE INVENTION

As is generally well known, some people, particularly elderly people or people with limited physical capabilities have difficulty making bedding when the end of the mattress must be lifted in order to tuck an edge of the bedding covers under a bottom surface of the mattress.

Prior to the present invention, effort has been made to alleviate such difficulty. U.S. Pat. No. 6,886,203 issued to Drakos et al. provides tubular lifting elements which are pivotally supported on a flat base member. Handles are provided at opposite ends enabling the person to lift the mattress.

However, this prior art has several disadvantages. First, tubular members provide only for sectional contact with a bottom surface of the mattress. Second, a combination of the separate base member and the tubular members pivotally attached thereto provides for greater than desirable complexity and cost of the device. The fixed dual handle arrangement limits the use of the device to a fixed mattress width as one handle will either protrude beyond the boundary of the narrower mattress or damage the bottom surface of a wider mattress.

SUMMARY OF THE INVENTION

According to one embodiment, the invention provides, in combination with a horizontally disposed mattress, a device for lifting an end of the mattress in a vertical direction. The device includes an elongated member positionable beneath the mattress and proximal to the end thereof. The elongated member is movable between a resting position wherein the elongated member is disposed generally coplanar with a bottom surface of the mattress and a lifting position wherein the member is disposed generally perpendicular to the bottom surface of the mattress and wherein a first edge of the elongated member continuously abuts a portion of the bottom surface for lifting the end of the mattress in the vertical direction. A handle is provided for selectively pivoting the elongated member between the resting and the lifting positions. The handle is secured to one end of the elongated member.

According to another embodiment of the invention, there is provided a device for lifting an end of a horizontally disposed mattress in a vertical direction. The device includes an elongated member having a predetermined length and a uniform cross-section throughout, the cross-section having a predetermined shape. The elongated member is movable between a resting position wherein the elongated member is disposed generally coplanar with a bottom surface of the mattress and a lifting position wherein the elongated member is disposed generally perpendicular to the bottom surface of the mattress and wherein a first edge of the elongated member abuts the bottom surface for lifting the end of the mattress in the vertical direction. An elongated slot is formed through a thickness of the elongated member in close proximity and parallel to one end thereof. A bore is formed in the one end of the elongated member and is aligned in a longitudinal direction. The bore extends through the elongated slot. A bracket is provided and is shaped to engage and partially cage the elongated member. The bracket has a first portion thereof adapted for fitting within the elongated slot. A threaded aperture is formed through the first portion of the bracket and is aligned with the bore when the first portion is disposed within the elongated slot. A handle is provide and has each of a predetermined thickness and a predetermined shape. A slot is formed through the handle in close proximity to one end thereof. The slot in the handle has a shape being generally identical to the cross-sectional shape of the elongated member, whereby the handle is attachable to the one end of the elongated member, and whereby an inner surface of the handle engages a surface of the bracket and an outer surface of the handle is disposed generally planar with the one end of the elongated member. A washer abuttingly engages the outer surface of the handle and the one end of the elongated member. A threaded fastener is passed through an aperture in the washer and is threadably received within the threaded aperture for releaseably securing the handle to the one end of the elongated member.

According to yet another embodiment, the invention provides a method of lifting one end of a horizontally disposed mattress in a vertical direction. The method includes the step of providing an elongated member having a predetermined length and a uniform cross-section throughout. Next, positioning the elongated member in a horizontal plane across a bottom surface of the mattress and adjacent the one end thereof. Then, pivoting the elongated member into a vertical position for lifting the one end of the mattress.

OBJECTS OF THE INVENTION

It is, therefore, one of the primary objects of the present invention to provide a device for lifting an end of a mattress.

Another object of the present invention is to provide a mattress lifting device which is simple and convenient to use by elderly people and by people with limited physical capabilities.

Yet another object of the present invention is to provide a mattress lifting device which is removably positioned under a bottom surface of the mattress.

A further object of the present invention is to provide a mattress lifting device which is secured to the mattress frame member.

Yet a further object of the present invention is to provide a mattress lifting device which is mounted integral to a mattress box spring member.

An additional object of the present invention is to provide a mattress lifting device which is economical to manufacture.

Another object of the present invention is to provide a mattress lifting device which has a uniform cross-sectional shape.

A further object of the present invention is to provide a mattress lifting device which can be used on mattresses of different widths.

Another object of the present invention is to provide a mattress lifting device which can be manually operated from either side of the mattress.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE DRAWINGS

FIG. 2 is an environmental view of the device of FIG. 1 shown in a resting position between the mattress and a box spring;

FIG. 3 is an environmental view of the device of FIG. 1 shown in a position for lifting one end of the mattress away from the box spring;

FIG. 4 is an isometric view of a clip alternatively employable for securing the handle onto the elongated member for lifting one end of the mattress;

BRIEF DESCRIPTION OF THE VARIOUS EMBODIMENTS OF THE INVENTION

Figure 1:
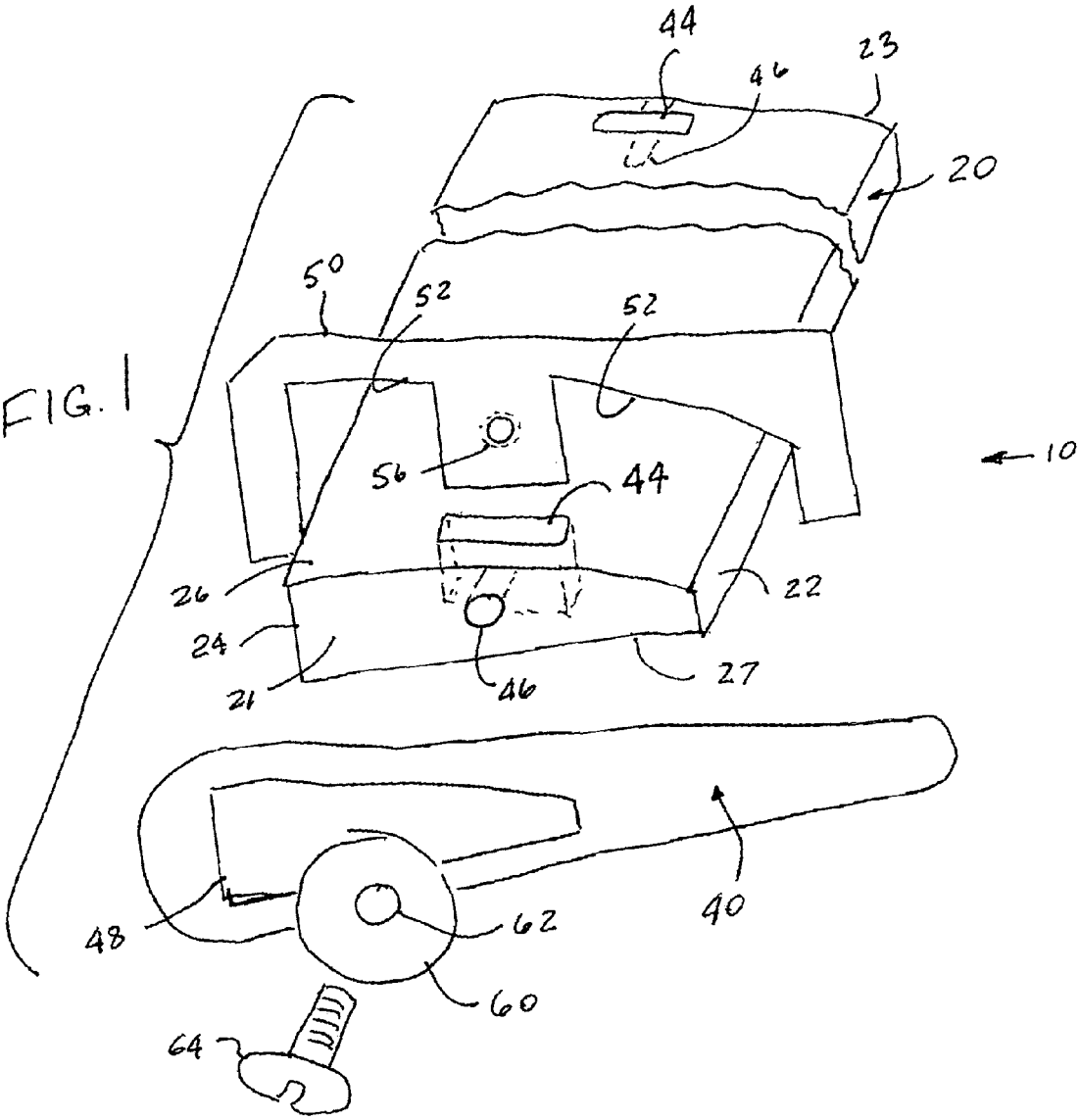
FIG. 1 is a perspective view of a device for lifting a mattress which is constructed according to a presently preferred embodiment of the invention.

Prior to proceeding to the more detailed description of the present invention, it should be noted that, for the sake of clarity and understanding, identical components which have identical functions have been identified with identical reference numerals throughout the several views illustrated in the drawing figures.

The best mode for carrying out the invention is presented in terms of its presently preferred embodiment, herein depicted within FIGS. 1 through 8. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

Reference is now made, to FIGS. 1-8, wherein there is shown a device, generally designated as 10, for lifting an end 4 of a mattress 2.

Now in a particular reference to FIGS. 1-4, the device 10 includes an elongated member, generally designated as 20, which has a first edge 22 and an opposite second edge 24. The first edge 22 has a generally planar surface and preferably has a thickness of about 0.25 inches. It is presently preferred that the second edge 24 is thicker than the first edge 22 and functions as a base when the elongated member 20 is moved into a position for lifting the end 4 of the mattress 2, as best shown in FIG. 3. The presently preferred width of the elongated member 20 is about 2.3 inches. It is also presently preferred for the elongated member 20 to have a uniform cross-sectional shape throughout for providing linear contact along an entire width portion of the mattress 2, thus evenly distributing the weight of the mattress 2 during manual lifting effort.

A first surface 26 of the elongated member 20 which abuts the bottom surface 6 of the mattress 2 when the elongated member 20 is in the resting position of FIG. 2 has an outwardly arcuate shape to facilitate lifting of the mattress 2 and for preventing damages to its bottom surface 6. An opposed second surface 27 of the elongated member is generally planar.

The elongated member 20 may be manufactured from any material selected from the group consisting of wood, plastic, metal and various combinations thereof.

The device 10 further includes a handle 40 which is disposed on and secured to a first end 21 of the elongated member 20 for pivoting the elongated member 20 between the resting and lifting positions.

It is presently preferred for the handle 40 to be releaseably secured to the first end 21 of the elongated member 20 for ease of repositioning the handle 40 to an opposed second end 23 of the elongated member 20 if required.

The handle 40 is generally flat and has a generally oval shape for facilitating gripping action by the user. The presently preferred thickness of the handle 40 is about 0.25 inches. The handle 40 may be manufactured from a material which is complimentary to the material of the elongated member 20 or from a different material.

It is presently preferred to secure the handle 40 in the following manner. An elongated slot 44 is formed through the elongated member 20 in close proximity and parallel to the first end 21 thereof. A bore 46 is formed in the first end 21 and is aligned in a longitudinal direction. The bore 46 extends through the elongated slot 44. A bracket 50 is provided and has an inner edge 52 shaped to abutingly engage the first surface 26 of the elongated member 20. The edges of the bracket 50 extend past the inner edge 52 for caging the edges 22, 24 of elongated member 20 therebetween. The bracket 50 also has a first portion 54 thereof extending outwardly from the inner edge 52 and adapted for fitting within the elongated slot 44. A threaded aperture 56 is formed through the first portion 54 of the bracket 50 and is aligned with the bore 46 when the first portion 54 is disposed within the elongated slot 44. A slot 48 is formed through the handle 40 in close proximity to one end thereof. The slot 48 has a shape being generally identical to the cross-sectional shape of the elongated member 20, whereby the handle 40 is attachable to the first end 21 of the elongated member 20, and whereby an inner surface of the handle 40 engages a surface of the bracket 50 and an outer surface of the handle 40 is disposed generally planar with the first end 21 of the elongated member 20. A washer 60 is placed in abutting relationship with the outer surface of the handle 40 and the first end 21 of the elongated member 20. A threaded fastener 64 is passed through an aperture 62 in the washer 60 and is threadably received within the threaded aperture 56 for releaseably securing the handle 40 to the first end 21 of the elongated member 20. Advantageously, the presently preferred flat bracket 50 provides support for the handle 40 and also functions as a stop.

Alternatively, means, such as a simple clip 42, best shown in FIGS. 3-4, may be wedged between the edge of the slot 48 and the surface 26 or 27 of the elongated member 20 for securing the handle 40 onto the first end 21 thereof.

In use, the presently preferred device 10 of FIGS. 1-4 is simply positioned beneath the surface 6 of the mattress 2 for abutting engagement with a box spring member 70. The user conveniently grips the handle 40 for pivoting the elongated member 20 in a plane which is coplanar to the edge surface 8 of the mattress 2 between a resting position wherein the elongated member 20 is disposed generally coplanar with a bottom surface 6 of the mattress 2, as best shown in FIG. 2, and a lifting position wherein the elongated member 20 is disposed generally perpendicular to the bottom surface 6 for lifting the end 4 of the mattress 2 as best shown in FIG. 3. When the end 4 of the mattress 2 is lifted in FIG. 3, the user can simply tuck the top sheet and blanket (not shown) under the bottom surface 6 and then lower the end 4.

When the end 4 of the mattress 2 is lifted in FIG. 3, the weight of the end 4 is evenly distributed along the entire length of the first edge 22 of the elongated member 20 providing for an improved life of the mattress 2 due to frequent and repetitive use of the device 10.

Depending on the size of the mattress, the user determines the distance from the end 4 of the mattress 2 in order to position the device 10 and prevent sagging of the end 4 being lifted in FIG. 3.

It is also within the scope of the present invention to provide a second slot 44 and a second bore 46 formed through the second end 23 of the elongated member 20 for providing the user with a flexibility of attaching the handle 40 depending on the position of the mattress 2. For example, the mattress 2 may be positioned in a generally abutting relationship with a wall (not shown) of a dwelling (not shown) enabling the user to access only one end of the elongated member 20. By providing the combination of the second slot 44 and the second bore 46, the user can simply attach the handle to the exposed and accessible end of the elongated member 20.

The employment of the flat and thin handle 40 and its attachment in a generally planar position with the first end 21 of the elongated member 20 prevents undesirable protrusion of the device 10 beyond the edge 8 of the mattress 8 and further prevents stabbing hazards to the leg portion of the user.

Figure 5:
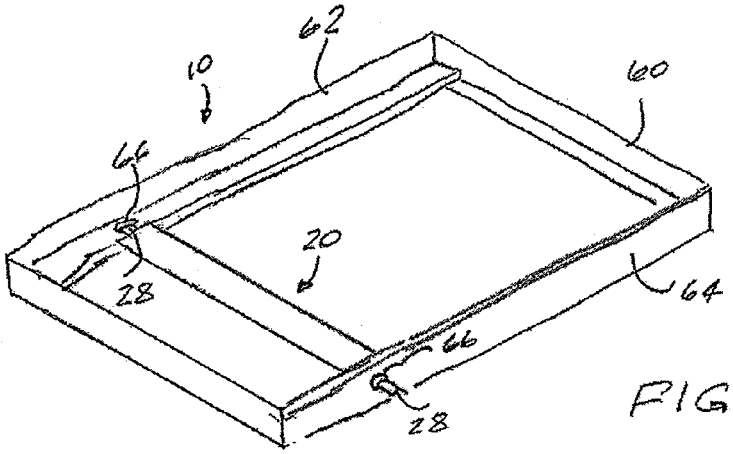
FIG. 5 is a perspective view of a device for lifting one end of a mattress which is constructed according to one alternative embodiment of the invention and which is pivotally attached to a mattress frame.

According to one alternative embodiment of FIG. 5, the elongated member 20 is pivotally secured to members 62, 64 of the conventional mattress frame 60 which are disposed in a well known parallel spaced relationship with each other. Each end of the elongated member 20 may be formed with a shaft portion 28 to operatively engage a complimentary round aperture 66 provided in each of the opposed members 62, 64.

Figure 6:
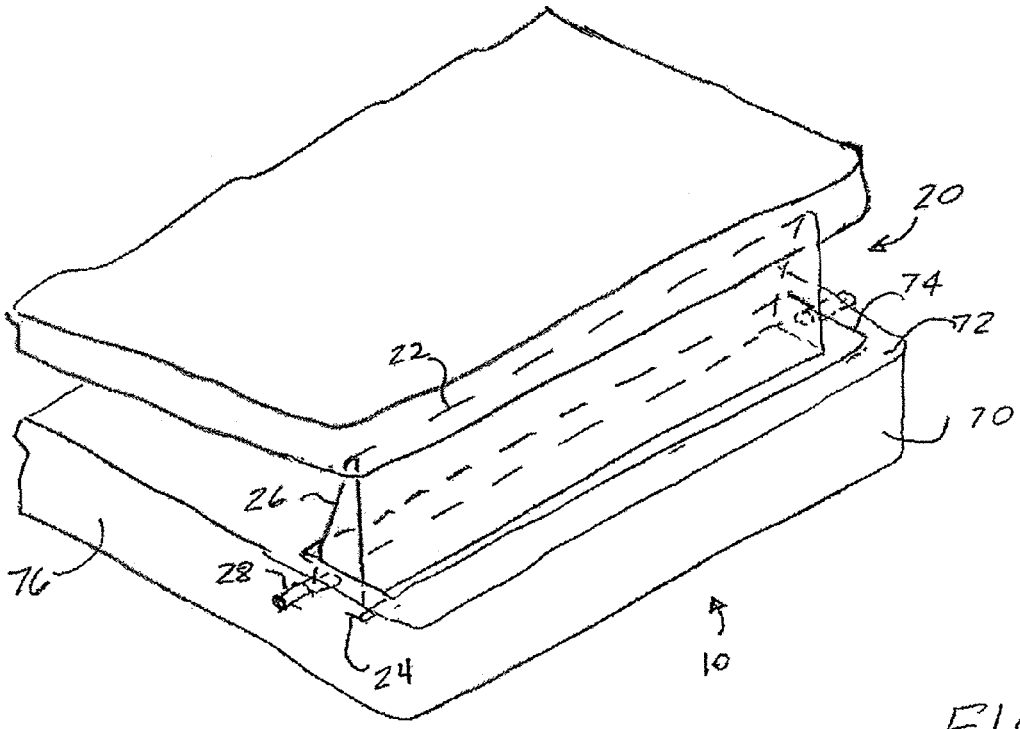
FIG. 6 is a perspective view of a device for lifting one end of a mattress which is constructed according to another alternative embodiment of the invention and which is pivotally attached within a box spring employed beneath the mattress.
Figure 7:
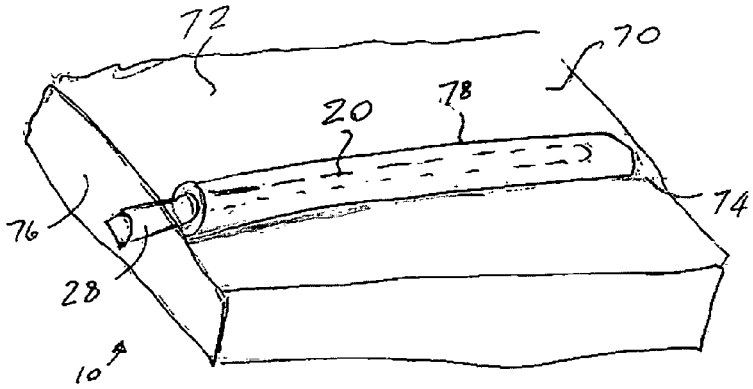
FIG. 7 is a perspective view of the device of FIG. 6, particularly illustrating a flexible cover.

According to another alternative embodiment of the invention, best shown in FIGS. 6-7, the elongated member 20 is pivotally mounted within the box spring 70 which has an elongated aperture 74 formed within the top surface 72 thereof for accommodating movement of the elongated member 20 between the first end second positions. The shaft portion 28 of the elongated member 20 extends outwardly past the edge 76 of the box spring member 70 for engagement with the handle 40. If required, a flexible cover 78 may be provided for covering the aperture 74.

Figure 8:
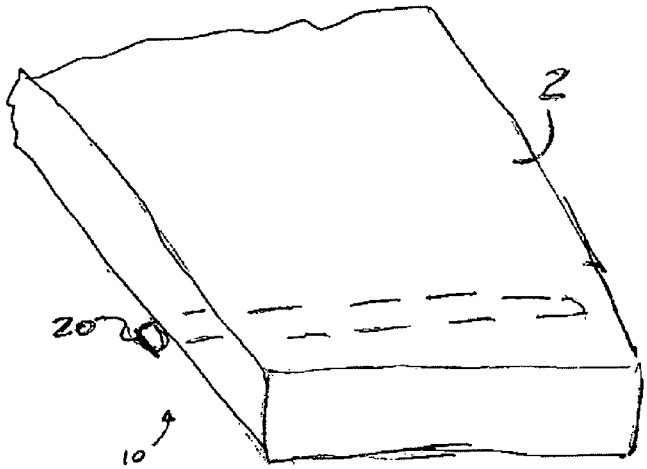
FIG. 8 is a perspective view of a device for lifting one end of a mattress which is constructed according to yet another alternative embodiment of the invention and which is pivotally attached to a bottom surface of the mattress.

The present invention further contemplates attaching the elongated member 20 to the bottom surface 6 of the mattress 2 as best shown in FIG. 8.

Although, the elongated member 20 has been illustrated in various figures as having a solid cross-section, it is within the scope of the present invention to provide the elongated member 20 with a hollow cross-section. For example, such elongated member 20 may be manufactured as a simple extrusion.

It has been also found that the device 10, particularly of FIGS. 1-4, may be employed with mattresses 2 of different width as the elongated member 20 may be made shorter than the width of the mattress 2 and still enable the user to lift the end 4 of such wider mattress 2.

Figure 9:
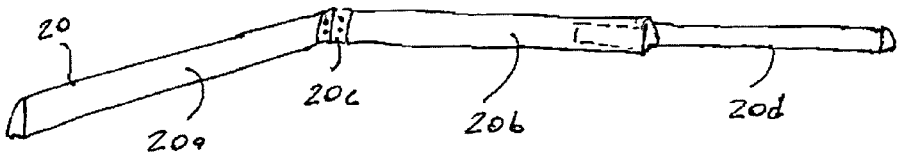
FIG. 9 is an isometric view of a device for lifting one end of a mattress which is constructed according to a further alternative embodiment of the invention, particularly illustrating the elongated member formed from a plurality of hinged or telescopic sections for ease of storage and transportation.

It is also within the scope of the present invention to form the elongated member 20 from a plurality of elongated sections for ease of storage and/or transportation. By way of an example only of FIG. 9, the elongated member 20 may includes at least two elongated sections 20*a* and 20*b* and a hinge or pivot 20*c* for pivotally connecting the adjacent ends of each section 20*a*, 20*b*. Or, such sections can be of a well known telescopic design as illustrated by sections 20*b* and 20*d*.

It will be understood that the sections 20*a*, 20*b*, 20*d* may be also transported in a detached condition from one another and assembled by the user into the elongated ember 20 either with the hinge or pivot 20*c* or any other suitable connection means. For example, when the elongated sections 20*a*, 20*b*, 20*d* are manufactured from wood, the adjacently disposed ends of the pair of sections may be formed with well known cooperating connection joints.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. In combination with a horizontally disposed mattress a device for lifting an end of said mattress in a vertical direction, said device comprising:

(a) an elongated member having a pair of opposed side edges, top and bottom surfaces and a pair of ends, at least one of said pair of ends having a bore disposed therein in alignment with a longitudinal direction of said elongated member, said elongated member positionable beneath said mattress and proximal to said end thereof, said elongated member movable between a resting position wherein said bottom surface of said elongated member is disposed generally coplanar with a bottom surface of said mattress and a lifting position wherein said bottom surface of said member is disposed generally perpendicular to said bottom surface of said mattress, wherein said top surface of said elongated member continuously abuts at least a portion of said bottom surface of said mattress during lifting said end of said mattress in said vertical direction, and wherein a first side edge of said elongated member abuts said bottom surface of said mattress when said elongated member is disposed in said lifting position;

(b) a handle for selectively pivoting said elongated member between said resting and said lifting positions, said handle having a slot formed through a thickness thereof in close proximity to one end of said handle; and (c) means for securing said handle to one end of said elongated member.

2. The device, according to claim 1, wherein said top surface of said elongated member abutting said at least portion of said bottom surface of said mattress being disposed in said resting position has an outwardly arcuate shape in a plane transverse to a length of said elongated member.

3. The device, according to claim 1, wherein said first edge has generally planar surface.

4. The device, according to claim 1, wherein an opposite second edge of said elongated member is thicker than said first edge thereof.

5. The device, according to claim 1, wherein said slot having a shape being generally identical to a cross-sectional shape of said elongated member.

6. The device, according to claim 1, wherein said securing means includes a clip.

7. The device, according to claim 1, wherein said securing means includes:

(a) an elongated slot formed through a thickness of said elongated member in close proximity and parallel to one end thereof;

(b) said bore extending through said elongated slot;

(c) a bracket shaped to engage and partially cage said elongated member, said bracket having a first portion thereof adapted for fitting within said elongated slot;

(d) a threaded aperture formed through said first portion of said bracket and aligned with said bore when said first portion is disposed within said elongated slot;

(e) said slot having a shape being generally identical to said cross-sectional shape of said elongated member, whereby said handle is attachable to said one end of said elongated member, and whereby an inner surface of said handle engages a surface of said bracket and an outer surface of said handle is disposed generally planar with said one end of said elongated member;

(f) a washer abuttingly engageable with said outer surface of said handle and said one end of said elongated member; and (g) a threaded fastener passed through an aperture in said washer and threadably received within said threaded aperture for releaseably securing said handle to said one end of said elongated member.

8. The device, according to claim 1, wherein said elongated member includes at least two elongated sections and a pivot means for pivotally connecting adjacent ends of said at least two elongated sections thus enabling said elongated member to be conveniently stored or transported.

9. A device for lifting an end of a horizontally disposed mattress in a vertical direction, said device comprising:

(a) an elongated member having a predetermined length and a uniform cross-section throughout, said cross-section having a predetermined shape, said elongated member movable between a resting position wherein said elongated member is disposed generally coplanar with a bottom surface of the mattress and a lifting position wherein said elongated member is disposed generally perpendicular to the bottom surface of the mattress and wherein a first edge of said elongated member abuts the bottom surface for lifting the end of the mattress in the vertical direction;

(b) an elongated slot formed through a thickness of said elongated member in close proximity and parallel to one end thereof;

(c) a bore formed in said one end of said elongated member and aligned in a longitudinal direction, said bore extending through said elongated slot;

(d) a bracket shaped to engage and partially cage said elongated member, said bracket having a first portion thereof adapted for fitting within said elongated slot;

(e) a threaded aperture formed through said first portion of said bracket and aligned with said bore when said first portion is disposed within said elongated slot;

(f) a handle having each of a predetermined thickness and a predetermined shape;

(g) a slot formed through said handle in close proximity to one end thereof, said slot having a shape being generally identical to said cross-sectional shape of said elongated member, whereby said handle is attachable to said one end of said elongated member, and whereby an inner surface of said handle engages a surface of said bracket and an outer surface of said handle is disposed generally planar with said one end of said elongated member;

(h) a washer abuttingly engageable with said outer surface of said handle and said one end of said elongated member; and (i) a threaded fastener passed through an aperture in said washer and threadably received within said threaded aperture for releaseably securing said handle to said one end of said elongated member.

10. The device, according to claim 9, wherein said device includes a second elongated slot formed through said thickness of said elongated member in close proximity and parallel to an opposed end thereof and a second bore formed in said opposed end of said elongated member and aligned in said longitudinal direction, said second bore extending through said second elongated slot.

11. The device, according to claim 9, wherein said predetermined length is less than a width of the mattress.

12. A method of lifting one end of a horizontally disposed mattress in a vertical direction, said method including the steps of:

(a) providing an elongated member having a predetermined length and a uniform cross-section throughout;

(b) positioning said elongated member in a horizontal plane underneath a bottom surface of said mattress and adjacent said one end thereof;

(c) abutting an outwardly arcuate shaped surface of said elongated member with said bottom surface of said mattress; and (d) pivoting said outwardly arcuate shaped surface of said elongated member about one edge thereof into a vertical position for lifting said one end of said mattress.

13. The method, according to claim 12, wherein said method includes the additional step of pivotally mounting said elongated member to a frame supporting said mattress in said horizontal position.

14. The method, according to claim 12, wherein said method includes the additional step of pivotally mounting said elongated member within an aperture formed in a spring box member supporting said mattress in a horizontal position.

15. The method, according to claim 14, wherein said method includes the additional step of covering said aperture with a flexible cover enabling pivotal movement of said elongated member within said spring box.

16. The method, according to claim 12, wherein said pivoting step includes the step of attaching a handle to one end of the elongated member and the step of gripping, by a user, said handle for pivoting said elongated member.

17. The method, according to claim 12, wherein said method includes the additional step of forming said elongated member from a plurality of telescopic or pivoting sections.

* * * * *